United States Patent [19]

Suzuki et al.

[11] Patent Number: 4,680,252

[45] Date of Patent: Jul. 14, 1987

[54] SILVER HALIDE LIGHT-SENSITIVE PHOTOGRAPHIC MATERIAL FOR RADIOGRAPHIC USE

[75] Inventors: Akio Suzuki; Takeo Koitabashi; Masatoshi Iwata; Hisashi Yamaguchi; Syoji Matsuzaka, all of Hino, Japan

[73] Assignee: Konishiroku Photo Industry Co., Ltd., Tokyo, Japan

[21] Appl. No.: 757,518

[22] Filed: Jul. 19, 1985

Related U.S. Application Data

[63] Continuation of Ser. No. 659,857, Oct. 11, 1984, abandoned, which is a continuation of Ser. No. 406,854, Aug. 9, 1982, abandoned.

[30] Foreign Application Priority Data

Aug. 21, 1981 [JP] Japan ..... 56-130215

[51] Int. Cl.[4] ..... G03C 1/02; G03C 1/06; G03C 1/76

[52] U.S. Cl. ..... 430/364; 430/567; 430/569; 430/966; 430/967

[58] Field of Search ..... 430/567, 569, 966, 967, 430/364

[56] References Cited

U.S. PATENT DOCUMENTS

| | | | |
|---|---|---|---|
| 3,912,933 | 10/1975 | Van Stappen | 430/966 |
| 4,047,956 | 9/1977 | Blake | 430/364 |
| 4,177,071 | 12/1979 | DeBrabandere | 430/569 |

OTHER PUBLICATIONS

Spottiswoode, "Film and its Techniques", 1964, pp. 183–185.

Brooks, How to Select and Use Photographic Materials and Processes, 1979, pp. 115–116.

*Primary Examiner*—John Kittle
*Assistant Examiner*—Mukund J. Shah
*Attorney, Agent, or Firm*—Jordan B. Bierman

[57] ABSTRACT

A silver halide light-sensitive photographic material for radiographic use comprising a transparent support and a silver halide emulsion layer on both sides thereof such that the blue light transmission density difference between the support and the silver halide layer is ≧0.35 and ≦0.60.

6 Claims, 3 Drawing Figures

SILVER HALIDE LIGHT-SENSITIVE PHOTOGRAPHIC MATERIAL FOR RADIOGRAPHIC USE

PRIOR APPLICATION

This application is a continuation of U.S. patent application Ser. No. 659,857 filed Oct. 11, 1984 which in turn is a continuation of U.S. patent application Ser. No. 406,854 filed Aug. 9, 1982, both now abandoned.

The present invention relates to a silver halide light-sensitive photographic material for radiographic use capable of being rapidly processed, particularly to a silver halide light-sensitive photographic material for medical radiography use having a transparent support coated on both sides thereof with a silver halide emulsion that may be subjected to the irradiation of X-rays in combination with a fluorescent or phosphorescent material of an intensifying screen or the like, and more particularly to a silver halide light-sensitive photographic material for medical radiography use that becomes sufficiently highly sensitive when subjected to the iradiation of X-rays in combination with a fluorescent or phosphorescent material.

In the radiographing with the use of a silver halide light-sensitive photographic material, various techniques have been employed for the purpose of reducing the exposure dose to a patient, radiographer or surgical operator, but these techniques are essential not merely for the reduction of the exposure dose to individuals but for the reduction of the opportunity of the collective exposure to X-radiation.

Recently, with the increase in the number of medical X-ray checks, the reduction of the exposure dose of X-radiation has been strongly demanded not only in medical circles but by world opinion.

In order to meet this demand, such devices or means as fluorescent intensifying screens, intensifying screens, fluorescent screens, X-ray image intensifier tubes and the like have been used, and there have recently been remarkable progresses in the improvement of these devices or means as well as in the increase in the sensitivity of light-sensitive photographic materials for radiographic use.

On the other hand, the latest progress of techniques of medical X-ray checks has stimulated the performance of more highly reliable examinations that require a radiographing technique using the irradiation of a large dose, and in order to meet this requirement an X-ray generator of a large capacity also has been developed. However, such a radiographing work that requires a large dose is undesirable because it rather runs counter to the desire for reducing the exposure dose. And also for this reason, the development of a further highly sensitive light-sensitive material has now been strongly demanded.

Hence, it is an object of the present invention to provide a silver halide light-sensitive photographic material for radiographic use capable of being highly sensitive when subjected to the irradiation of X-rays in combination with a fluorescent intensifying screen, intensifying screen, or fluorescent screen (hereinafter referred to as fluorescent screen) comprising a fluorescent or phosphorescent material caused to be luminous by the action of X-radiation. Another object of the present invention will become clarified in the following descriptions of the present invention.

The above object of the present invention may be attained by a silver halide light-sensitive photographic material for radiographic use having a transparent support provided with a silver halide emulsion layer on both sides thereof, which is to be subjected to exposure to X-rays in combination with a fluorescent or phosphorescent substance which is caused to be luminous by the action of X-ray irradiation, and is then developed to obtain a silver image, the light-sensitive photographic material characterized in that the value obtained by subtracting the blue light transmission density $D_S$ of said transparent support from the blue light transmission density $D_M$ of said light-sensitive photographic material is not more than 0.60.

The preferable embodiment of the present invention is such that at least 80% by weight or by the number of the silver halide crystals have a regular crystal shape and at least 95% by weight or by the number of the silver halide crystals have crystal sizes of ±40% within the average crystal size.

The blue light transmission density described herein means the value of density Status A obtained by the measurement in accordance with the method reported by Dawson and Voglesong in Photographic Science and Engineering, 17, 461–468 (1973).

The value of density Status A may be obtained by measuring with the use of a Status AA filter having normal spectral density as FIG. 1. The thus measured value of density Status A is widely used because there is little deviation in the value among the densitometers used, so that highly reliable data can be obtained.

Examples of optical densitometers that enable such the value of density Status A are Macbeth Transmission Densitometers TD-504A and TD-do4AM, manufactured by Macbeth Company. These optical densitometers are of the parallel incident, diffuse light-receiving type having a tungsten halogen lamp as the light source thereof provided with a blue filter, the above-mentioned Status AA filter.

The results of our study show that the smaller the value of the above blue light transmission density, the higher does the sensitivity in the system wherein a fluorescent screen is used to X-rays become as compared to the sensitivity to ordinary light, whereas when the value obtained by subtracting the blue light transmission density of the transparent support from that of the light-sensitive photographic material is lowered to less than 0.35, the sharpness of the image is deteriorated due to the known cross-over phenomenon (or print-through phenomenon). From this point of view, the above-mentioned subtracted blue light transmission density value is to be from 0.60 to 0.35, and preferably from 0.57 to 0.35.

The object of increasing the transmittance of the blue light with the light-sensitivity maintained may be attained by the sensitization of the emulsion by means of the improvement of chemical sensitization, the optimization of silver iodide content, the optimization of the crystal habit and size distribution of silver halide crystals, using sensitizing dyes and a development accelerator, and the like and then by rendering the silver halide particles finer-grained and lowering the coating amount with respect to silver.

The silver halide photographic material of the present invention can be prepared in such a manner, for example, that a monodispersed emulsion containing octahedral silver halide crystals with the average crystal size of 1.07$\mu$, on which reduction sensitization is done with the interior thereof and sulfur and gold sensitization is conducted on the surface thereof, is coated on both sides of a support with the coating amount of 25 mg/1000 $cm^2$ with respect to silver.

According to another embodiment of the present invention, an emulsion containing polydispersed tetradecahedral crystals with the average crystal size of 1.0μ which consist of silver iodobromide containing 2.0 mol% of silver iodido covered with a pure silver bromide shell on its surface, an which reduction sensitization is done with the interior thereof and sulfur and gold sensitization is conducted on the surface thereof, is coated on both sides of a support with the coating amount 28 mg/100 $cm^2$ with respect to silver to prepare the photographic material.

Other embodiments will also be illustrated hereinafter in the Examples.

A preferable embodiment of the present invention can provide a silver halide light-sensitive photographic material for radiographic use that enables to obtain a high-sensitivity, high quality radiographed image without altering the existing radiographic image processing system. The preferable embodiment uses silver halide crystals having regular structures or shapes-that is, we have found that the silver halide emulsion wherein at least 80% by weight or by the number of the silver halide crystals thereof have a regular crystal shape, although it has the same transmission density to the blue light as that of the silver halide emulsion containing less than 80% has higher sensitivity to X-rays in the system wherein a fluorescent screen is used and has less deterioration of the image due to the cross-over effect.

The silver halide particles having regular structure or shape do not include those crystals that anisotropically grow such as those having twinning planes, and means only those crystals that isotropically grow such as, for example, those crystals in the tetradecahedral, octahedral, or spherical form. The silver halide emulsion used in the present invention may contain silver halide crystals having irregular crystal habit. However, such crystals should not preferably incorporated in the emulsion at a proportion more than 20% by weight or by the number of total crystals. According to a preferable embodiments of the invention, at least 80 to 90% by weight or with respect to the total number, crystals consist of regular crystals.

The silver halide emulsion containing silver halide crystals essentially consisting of regular crystals can be prepared by controlling the reaction condition of the crystal growth process in the double jet method, wherein silver halide crystals are formed crystalized in an aqueous protective coloidal solution by mixing equivalent amount of silver nitrate solution and halide solution under high-stirring condition.

In the double-jet mixing method the addition rates of both aqueous silver nitrate and aqueous halide solutions are often made increased proportionally to the growth of silver halide crystals.

In the double-jet mixing method, mixing is generally conducted under such conditions; i.e. about 1.5 to 10 with respect to pH value and prefarable 2 to 9, about 4 to 10.5 with respect to pAg value, which should be adjusted in accordance with pH about 30° C. to 90° C. with the reaction temperature. The method for producing those silver halide regular crystals are in the prior art as described in, e.g., J. Phot. Sci., 5, 332 (1961), Ber. Bunsenges, Phys. Chemi. 67, 949 (1963), Intern. Congress Phot. Sci. Tokyo (1967), and the like.

As the result of our study, we have found that the conventional photographic emulsion, because the particle size thereof is irregular, if the sensitivity thereof is adjusted to that of a monodispersed emulsion, becomes inferior in the image quality, particularly in the graininess thereof, and also have found that even if the transmittances of the blue light were on the same level, the emulsion having a narrow particle size distribution has a higher sensitivity to X-rays in the system wherein a fluorescent screen is used and has less deterioration of the image quality due to the cross-over effect than the emulsion of a wide particle size distribution has.

While on the other hand, another preferable embodiment of the present invention can provide a silver halide light-sensitive photographic material for radiographic use that enables to obtain a high sensitivity, high quality radiographic image. The preferable embodiment uses a monodispersed emulsion.

The monodispersed emulsion intended for use in the present invention is composed of a silver haldie emulsion wherein at least 95% by weight or by the number of the silver halide crystals thereof are determined to have particle size of ±40% within the average particle size, and preferably ±30% when measurement of the average particle size is made in the manner as disclosed by Trivelli and Smith in The Photographic Journal, 79, 330–338 (1939).

Such a monodispersed emulsion may be prepared by the double-jet mixing process as described hereinbefore. Mixing conditions in this case is similar to those taken nearly the in the preparation of silver halide regular crystals, however, the addition rates of both solutions must be controlled more carefully so that nucleation of new crystals may not take place. The addition rate will be increased with the growth of silver halide crystals to get a narrower size distribution, but when the addition rate exceeds cirtical point, nucleation of new crystals is brought about. The critical addition rate changes depending upon various factors such as temperature, pH, pAg, stirring rate, composition of silver halide, solubility thereof, crystal size, distance among crystals in the solution crystal habit, kind of protective colloid to be used and its concentration in the solution and so on.

The method for producting such a monodispersed emulsion is in the prior art as disclosed in, e.g., J. Phot. Sci., 12, 242–251 (1963), Japanese Patent Publication Nos. 36890/1973 and 16364/1977, and Japanese Patent O.P.I. Publication No. 142329/1980, and in addition, another method as described in Japanese Patent Application No. 65573/1981 may also be used.

The silver halide particles used in the present invention may be produced by the application of such processes as the neutral process, acid process, ammoniacal process, orderly mixing process, inversely mixing process, double jet process, controlled double jet process, conversion process, core/shell process, or the like as described in "The Theory of the Photographic Process" by T. H. James, 4th ed., 88–104 (1977), published by Macmillan. As the silver halide, any such a composition as silver chloride, silver bromide, silver chlorobromide, silver iodobromide, silver chloroiodobromide, or the like may be used, but the most preperred emulsion is silver iodobromide emulsion containing silver iodide in the quantity of not more than about 10 mol%.

The silver halide particle size, although there is no particle limitation thereto, is preferably from 0.1 to 2μ. The silver halide crystals or silver halide emulsion may contain an iridium salt and/or a rhodium salt for the purpose of improving the characteristic thereof to flash light exposure.

The silver halide to be used in the present invention may generally be chemically sensitized by the single or combined use of such chemical sensitizers as sulfur sensitizers such as sodium thiosulfate, thiourea; noble metal sensitizers such as gold sensitizers including chloroaurate, gold trichloride, etc.; palladium sensitizers such as palladium chloride, chloropalladate, etc.; platinum compounds, iridium compounds; selenium sensitizers such as selenious acid, selenourea, etc.; reduction sensitizers such as stannous chloride, polyamines such as diethylenetriamine, sulfites, silver nitrate, and the like, and may be spectrally sensitized in the desired wavelength region by the single or combined use of such spectral sensitizers as cyanine dyes, merocyanine dyes, and the like as described in, e.g., U.S. Pat. Nos. 2,493,784, 2,519,001, 2,977,229, 3,480,343, 3,572,897, 3,703,377, 2,688,545, 2,912,329, 3,397,060, 3,511,664, 3,522,052, 3,527,641, 3,615,613, 3,615,632, 3,615,635, 3,615,641, 3,617,295, 3,617,293, 3,628,964, 3,635,721, 3,656,959, 3,694,217, 3,743,510, 3,769,301 and 3,793,020 and Japanese Patent O.P.I. Publication No. 31227/1976 and 107127/1976.

As the binder material for the photographic emulsion to be used in the present invention, gelatin derivatives, synthetic hydrophilic polymers or the like may be used in addition to gelatin.

Into the photographic emulsion for use in the present invention there may be incorporated various photographic additives: antifogants such as azaindenses including 4-hydroxy-6-methyl-1,3,3a,7-tetrazaindene, triazoles, thiazoles, tetrazoles, and other antifogants known to those skilled in the art; hardeners such as aldehyde compounds, ketone compounds, halogen-substituted acids such as mucochloric acid, ethyleneimide compounds, vinyl sulfone compounds, etc.; coating acids such as saponin, lauryl or oleyl monoethers of polyethylene glycol, etc.; development accelerators, although there is no particular limitation thereto, including benzimidazole compounds (as described in, e.g., Japanese Patent O.P.I. Publication No. 24427/1974), thioether compounds, polyalkylene oxide compounds, onium or poly-onium compounds of the type of ammonium, phosphonium and sulfonium; physical property-improving agents such as polymer latex comprising homo- or co-polymers of alkyl acrylates, alkyl methacrylates, acrylic acid, etc.; and the like.

To the silver halide photographic emulsion for use in the present invention there may be added such antistatic agent as a compound (as described in, e.g., Japanese Patent O.P.I. Publication No. 56220/1976) which is obtained by the addition copolymerization of phenol aldehyde condensate with glycidol and ethylene oxide; a lanolin ethylene oxide adduct and alkaline metallic salt and/or alkaline earth metallic salt (as described in, e.g., Japanese Patent O.P.I. Publication No. 70837/1980); a water-soluble inorganic salt and matting agent (Japanese Patent O.P.I. Publication No. 161230/1980); an addition condensation product prepared by the addition condensation of a phenol alkehyde condensate with glycidol and ehtylene oxide, and a fluorine-containing succinic acid compound; or the like. Furhter, a pH adjusting agent, viscosity increasing agent, graininess improving agent, and matting agent, and furthermore, various photographic additives such as a surfactant used as a coating aid such as saponin, sulfosuccinate, etc., antistain agent, or the like may also be used. And there may also be used those materials as described in, e.g., Japanese Patent O.P.I. Publication Nos. 14732/1975, 91315/1975 and Japanese Patent Publication No. 2935/1978. These above-mentioned various photographic additives may also be incorporated into layers other than the silver halide emulsion layers, and as the binder material therefor the same material as aforementioned may be used.

For the transparent support applicable to the present invention, such a transparent material as, e.g., polyethylene threphthalate film, polycarbonate film, polystyrene film, cellulose acetate film or the like may be arbitrarily used. The support may be tinted to an arbitrary color, preperably to light blue.

The fluorescent screen for use in the present invention is one that contains a fluorescent or phosphorescent material which is caused to be luminous by the action of X-rays, such as those consisting principally of calcium tungstate ($CaWO_4$) or thoe rare earth compounds activated by terbium (Tb), particularly those having the general formula: $X_2O_2S$:Tb wherein X represents an element selected from the group consisting of lanthanum (La), cerium (Ce), praseodymium (Pr), samarium (Sm), europium (Eu), gadolinium (Gd), Terbium (Tb), dysprosium (Dy), holmium (Ho), erbium (Er), thrlium (Tu), ytterbium (Yb), lutetium (Lu), scandium (Sc) and yttrium (Y). And if the light-sensitive photographic material of the invention is subjected to the irradiation of X-rays in combination with the above-mentioned fluorescent screen and subsequently to a given processing, the object of the present invention can be accomplished. The words "irradiation of X-rays" used herein means the irradiation of high energy by electromagnetic wave; to be more concrete, the irradiation by X-rays or, X-rays and rays.

The developing-fixing process for the light-sensitive material of the present invention is capable of sufficiently withstanding a rapid processing at a high temperature with doing no harm to any characteristic of the material and may be applied to an ultra high-speed processing which utilizes the amplifying technique known to those skilled in the art or which is for the emulsion containing a reducing agent having a ballasting group, so that a color developing may be carried out.

The present invention is subsequently illustrated with reference to examples, but the embodiment of the present invention is not limited thereto.

EXAMPLE 1

A silver iodobromide emulsion containing 1.5 mol% silver iodide was prepared under the conditions controlled at 60° C., pAg 8.0 and pH 2.0 by the double jet process to thereby obtain a monodispersed cubic crystal emulsion (I) with the average crystal size of 0.3μ. After desalting, a silver nitrate solution was added to the emulsion to carry out a silver ripening under the conditions of 55° C., pAg 2.5 and pH 6.0. Further to the emulsion were added an ammoniacal silver nitrate solution and a solution containing potassium bromide and 2.0 mol% potassium iodide by the double jet process to grow the crystals from the 0.3μ to 1.0μ in the crystal size, thereby producing Emulsion (A). This emulsion (A) was a monodispersed cubic crystal emulsion.

And the above-mentioned monodispersed cubic crystal emulsion (I) was caused to grow up to 1.5μ, without being subjected to any ripening, to thereby produce Emulsion (B), which also was a monodispersed cubic crystal emulsion.

Further, another silver iodobromide emulsion having the same composition as that of Emulsions (A) and (B) by the orderly mixing process to thereby prepared Emulsion (C) of the polydispersed twinned crystal emulsion having the average crystal size of 1.10μ.

To each of these emulsion, after being subjected to desalting, and then gold-sensitizing and sulfur-sensitizing treatments, were added 4-hydroxy-6-methyl-1,3,3a,7-tetrazaindene for stabilization, and such general photographic additives as a coating aid, hardener, etc., and the thus pepared emulsion was coated on a blue-tinted, subbed polyethylene terephthalate film support so that the coated silver amount of 28 mg/100 $cm^2$ is provided on each of both sides of the support, and then dried, whereby radiographic light-sensitive material samples No. 1 to No. 3 were produced.

Sensitometry tests were made on thses samples by subjecting each of these samples to two different exposures: part of each of the samples was exposed for 1/50 second through an optical wedge to the light of a light source having the color temperature of 5,400° K., the exposure being 3.2 C.M.S., and the other part, with each sample sheet placed between a pair of fluorescent screen sheets ($CaWO_4$), was subjected for 1/20 second through an optical wedge to the irradiation of X-rays emitted from an X-radiation source with tube voltage of 100 kvp/tube current of 100 mA.

These exposed samples were processed in accordance with the following processing steps in a roller-transport type automatic processor.

| Processing steps | Processing temperature | Processing period |
|---|---|---|
| Developing | at 35° C. | 25 seconds |
| Fixing | at 34° C. | 25 seconds |
| Washing | at 33° C. | 25 seconds |
| Drying | at 45° C. | 15 seconds |

The composition of the developing solution used herein is as follows:

| | |
|---|---|
| Anhydrous sodium sulfite | 70 g |
| Hydroquinone | 10 g |
| Boric anhydrode | 1 g |
| Sodium carbonate, monohydrated | 20 g |
| 1-phenyl-3-pyrazolidone | 0.35 g |
| Sodium hydroxide | 5 g |
| 5-methyl-benzotriazole | 0.05 g |
| Potassium bromide | 5 g |
| Glutaric aldehyde hydrogensulfite | 15 g |
| Glacial acetic acid | 8 g |
| Water to make 1 liter | |

The results of these tests are as shown in Table 1. In the table, the sensitivities are expressed in relative sensitivities when that of Emulsion (C) determined in the light and X-ray sensitometry tests are regarded as 100, respectively.

The measurements for the blue light transmission densities were made by means of a Macbeth Transmission Densitometer TD-504AM provided with a Status AA filter.

The image quality was evaluated for the grainiess and sharpness by determining the values of RMS and OTF, respectively.

The measurement of RMS was carried out in the manner that an acryl plate with the thickness of 10 cm was placed in front of the sample put in between a pair of fluorescent screen sheets, and the sample was subjected to the irradiation of X-rays to that the total image density on both sides under the foregoing conditions becomes 1.0. And th emulsion layer on the front side facing the X-ray tube was then peeled apart from the support, and the emulsion layer on the other side was then measured by means of a SAKURA One-Touch Type RMS measuring instrument (manufactured by Konishiroku Photo Industry Co., Ltd.) with the aperture size thereof set to 50μ and with magnifying power of 5×10 times.

The measurement of OTF was made in the manner that an OTF measuring chart with a rectangular wave of 0.8–10 lines/mm made of lead was brought into contact with the back of the fluorescent screen located on the front side, and this unit was subjected to the irradiation of X-rays so that the total density on both sides of the sample in the area not shielded by the lead rectangular wave, and then, the emulsion layer on one side, as in the case of RMS measurement, was peeled apart, and after that, the rectangular wave pattern on the other side was measured by means of a SAKURA Microdensitometer Model M-5 (manufactured by Konishiroku Photo Industry Co., Ltd.) with the sample scanned in the direction normal to the rectangular wave; with the aperture size set to 230μ in the direction parallel with the rectangular wave and to 25μ in the direction normal thereto; and with magnifying power of 100 times. The results are as shown in Table 1 with respect to the values of RMS and in Table 2 with respect to the values of OTF.

TABLE 1

| | Blue light density | | | Light sensitometry | | X-ray sensitometry | | |
|---|---|---|---|---|---|---|---|---|
| Sample No. | Light-sensitive material | support | Difference | Sensitivity | Max. density | Sensitivity | Max. density | RMS |
| 1. Emulsion (A) | 0.60 | 0.05 | 0.55 | 100 | 4.0 | 125 | 4.0 | 0.112 |
| 2. Emulsion (B) | 0.65 | 0.05 | 0.60 | 98 | 3.5 | 110 | 3.5 | 0.120 |
| 3. Emulsion (C) | 0.72 | 0.05 | 0.67 | 100 | 3.5 | 100 | 3.5 | 0.121 |

As apparent from Table 1, monodispersed Emulsions (A) and (B), although nearly on the same level in the sensitivity as the polydispersed Emulsion (C), having significantly high sensitivities to X-rays under the conditions actually used in the field, high maximum densities, and, further, excellent image qualities as compared to Emulsion (C).

Meanwhile, Emulsion (A) has almost the same sensitivity as that of Emulsion (B), but the former having a small density to blue light has a fairly high sensitivity to X-rays as compared to the latter.

EXAMPLE 2

A silver iodobromide emulsion containing 2.0 mol% silver iodide was prepared under the conditions controlled at 60° C., pAg 4.0 and pH 2.0 by the double jet process to thereby obtain a monodispersed cubic crystal emulsion having the average crystal size of 0.4μ. After desalting, to the emulsion was added thiourea dioxide to carry out a reduction sensitization of the emulsion at 55° C.

Further, to this emulsion were added an ammoniacal silver nitrate solution and a potassium bromide solution containing 2.0 mol% potassium iodide at a rate exceeding the critical growth rate by the double jet process. Furthermore, the resulting emulsion particles were covered with the shell of pure silver bromide by adding both ammonical silver nitrate solution and potassium bromide solution in the double jet process. During this period, the pAg was maintained at 9.5, while the pH was gradually lowered from 9.0 to 8.0. The resulting emulsion was regarded as Emulsion (D), which was a polydispersed tetradecahedral crystal emulsion whose average crystal size was 1.0μ.

Another silver iodobormide emulsion having the same composition as that of Emulsion (D) was prepared by the orderly mixing process to thereby obtain Emulsion (E), which was a polydispersed twinned crystal emulsion having the average crystal size of 1.0μ.

These emulsions were then chemically sensitized, coated, and dried in the same manner as in Example 1, thereby obtaining samples, which are subsequently subjected to sensitometry tests, and after that, the image qualities of the samples were evaluated. The results of the tests are as shown in Table 2 and FIG. 3.

In addition, the sensitivities of these samples are given in relative sensitivities where those of Emulsion (C) in both light and X-ray sensitometry tests are regarded as 100, respectively.

TABLE 2

| Sample No. | Blue light density: Light-sensitive material | Blue light density: support | Blue light density: Difference | Light sensitometry: Sensitivity | Light sensitometry: Max. density | X-ray sensitometry: Sensitivity | X-ray sensitometry: Max. density | RMS |
|---|---|---|---|---|---|---|---|---|
| 4. Emulsion (D) | 0.63 | 0.05 | 0.58 | 110 | 4.0 | 135 | 4.0 | 0.113 |
| 5. Emulsion (E) | 0.63 | 0.05 | 0.58 | 90 | 4.0 | 105 | 4.0 | 0.117 |

As apparent from Table 2, both emulsions (D) and (E) whose subtracted blue light transmission densities are not more than 0.60 show that the sensitivities thereof to X-rays are significantly high as compared with those to ordinary light.

Both Emulsion (D) and Emulsion (E) are polydispersed emulsions, but the former that is composed of regular silver halide crystals permits largely increasing the sensitivity in X-ray sensitometry as compared to the latter.

And it was found that even in the case where similar experiments are performed with the mixture or multicoating of monodispersed emulsions different in the average crystal size the emulsion composed of regular silver halide crystals permits largely increasing the sensitivity in the X-ray sensitometry and further is excellent in the image quality as compared to the polydispersed twinned crystal emulsion.

EXAMPLE 3

In this Example, a monodispersed emulsion (I) was prepared in the same manner as in example 1. This emulsion was devided into two equal parts. One of the parts was added an aqueous silver nitrate solution and silver ripening was conducted under the condition of temperature at 55° C., pAg at 2.5 and pH at 6.0.

After the silver ripening, this emulsion was further devided into two equal parts. And to one of them was added by the double-jet mixing method an ammonical silver nitrate solution and a pottassium bromide solution containing 2.0 mol% of pottasium iodide simultaneously by gradually increasing the addition rate to obtain the average crystal size of 0.95μ.

Thus prepared crystals were then covered with pure silver bromide shell by adding ammonical silver nitrate solution and pottassium bromide solution through the double jet process under the condition that pAg was kept constant at 10.0 and pH was gradually lowered from at 9.0 to at 0.8. Thus emulsion (F) was prepared. This emulsion (F) was a monodispersed emulsion containing silver halide crystal with the average crystal size of 1.0μ. The other part of the silver ripened emulsion was subjected to further mixing in the similar manner as in the case of Emulsion (F) to grow the size of the silver halide crystals until the average crystal size becomes 1.07μ except that in this case shell formation was excluded. Thus Emulsion (G) was prepared. This Emulsion (G) was also a monodispersed emulsion containing octahedral crystals. Another part of Emulsion (I) which was not subjected to silver ripening was devided into two equal parts. And one part thereof was subjected to further mixing to grow the silver halide crystals to have the average crystal size of 1.15μ in the same manner as Emulsion (G) thus Emulsion (H). This Emulsion (H) was also a monodispersed emulsion containing octahedral silver halide crystals. The other part of the emulsion which was not subjected to silver ripening was undergone further mixing by double-jet mixing process to grow the size of silver halide crystals to have the average crystal size of 1.25μ by gradually increasing the addition rate of ammonical silver nitrate solution and potassium bromide solution. Thus Emulsion (J) was obtained. The conditions of pAg and pH taken during the growth process was the same as that of the preparation of Emulsion (F). Emulsion (J) was also a monodispersed emulsion containing octahedral silver halide crystals.

These emulsions were then chemically sensitized, coated, and dried in the same manner as in Example 1, thereby obtaining samples, which were subsequently subjected to sensitometry to evaluate the image qualities. In this Example the coating amount of silver of each samples was 25 mg/100 $cm^2$, and with respect to Emulsion (F), the samples having coating amount of silver of 18 mg/100 $cm^2$ and 15 mg/100 $cm^2$ were also prepared. Image qualities were evaluated in terms of RMS and visual image performance. Image performance was visual decision of the sharpness of phantom image. The results of the tests are as shown in Table 3.

The sensitivities of these samples are given in terms of relative sensitivities where those of Emulsion (C) to light and X-ray are regarded as 100, respectively.

And the image performances is shown with the following mark, O, Δ and ×, which respectively means;

O: good

Δ: usable but not very good

×: too bad to use.

TABLE 3

| Sample No. | Coating Ag-amount (mg/100 cm²) | Blue light density: Light-sensitive material | Blue light density: support | Blue light density: Difference | Light Sensitometry: Sensitivity | Light Sensitometry: Max. density | X-ray Sensitometry: Sensitivity | X-ray Sensitometry: Max. density | RMS | Visual image performace |
|---|---|---|---|---|---|---|---|---|---|---|
| 6. Emulsion (F) | 25 | 0.58 | 0.05 | 0.53 | 105 | 3.60 | 137 | 3.60 | 0.112 | O |
| 7. Emulsion (G) | 25 | 0.63 | 0.05 | 0.58 | 105 | 3.35 | 132 | 3.35 | 0.113 | O |
| 8. Emulsion (H) | 25 | 0.67 | 0.05 | 0.62 | 103 | 3.15 | 105 | 3.15 | 0.118 | Δ |
| 9. Emulsion (J) | 25 | 0.70 | 0.05 | 0.65 | 103 | 2.90 | 103 | 2.90 | 0.124 | Δ |
| 10. Emulsion (F) | 18 | 0.43 | 0.05 | 0.38 | 75 | 2.60 | 100 | 2.60 | 0.113 | O |
| 11. Emulsion (F) | 15 | 0.38 | 0.05 | 0.33 | 65 | 2.15 | 90 | 2.15 | 0.114 | X |

As apparent from Table 3 samples Nos. 6, 7 whose subtracted blue light transmission densities are not more than 0.60 according to the present invention show that the sensitivities thereof to X-rays are significantly high as compared with those to ordinary light and that they have excellent graininess.

On the other hand, samples Nos. 11 whose subtracted blue light transmission densities are less than 0.35 show that thier image performance are too deteriorated for practical use.

Figure 1:
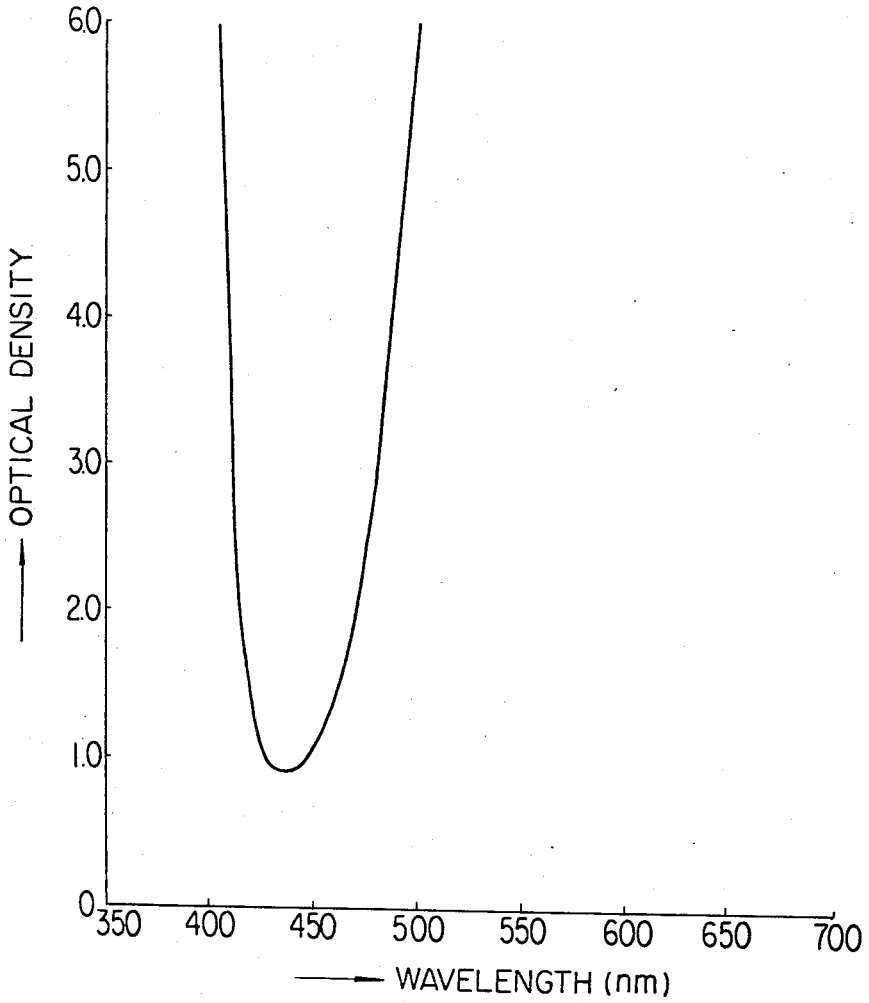
FIG. 1 is a graph showing the spectral densities of Status AA Filter.
Figure 2:
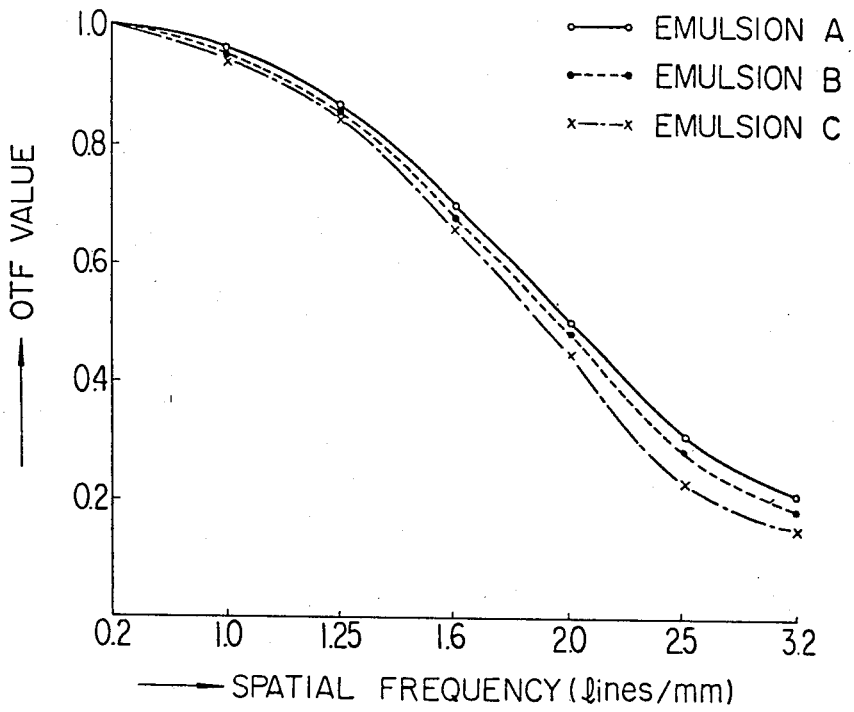
FIG. 2 and FIG. 3 are graphs showing the relations between the spatial frequencies and OTF values of the respective emulsions.
Figure 3:
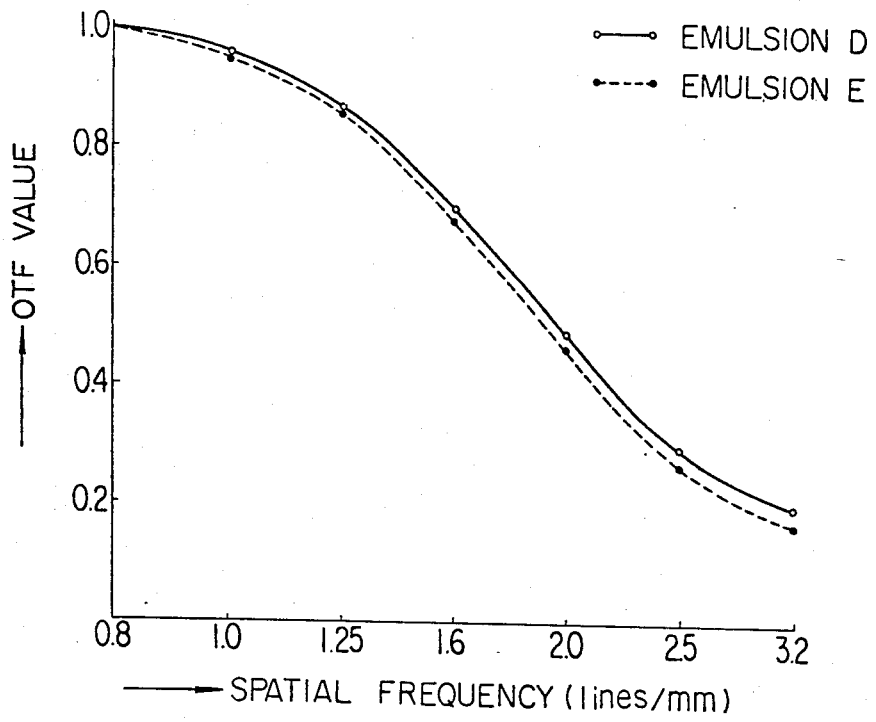

We claim:

1. A silver halide light-sensitive photographic material for radiographic use comprising a transparent support provided with a silver halide emulsion layer on both sides thereof, said support having a blue light transmission density $D_S$ and said material having a blue light transmission density $D_M$, both before development, whereby $0.35 \leqq D_M - D_S \leqq 0.60$.

2. The material of claim 1 wherein $D_M - D_S \leqq 0.57$.

3. A method of using a silver halide light-sensitive photographic material for radiographic use comprising a transparent support provided with a silver halide emulsion layer on both sides thereof, said support having a blue light transmission density $D_S$ and said material having a blue light transmission density $D_M$, both before development, whereby $0.35 \leqq D_M - D_S \leqq 0.60$, said method comprising exposing said material in conjunction with a fluorescent or phosphorescence substance to X-ray radiation and developing said material to obtain a a silver image.

4. A silver halide photographic light-sensitive material for radiographic use according to claim 1 wherein at least 80% by weight or by the number of said silver halide crystals have a regular crystal shape.

5. A silver halide light-sensitive photographic material for radiographic use according to claim 1 wherein at least 95% by weight or by the number of silver halide crystals have crystal sizes of ±40% within the average crystal size thereof.

6. A silver halide light-sensitive photographic material for radiographic use according to claim 1 wherein said silver halide crystals consist essentially of silver iodobromide having not greater than 10 molar % of silver iodide.

* * * * *